US010676337B2

(12) United States Patent
Hecht

(10) Patent No.: US 10,676,337 B2
(45) Date of Patent: Jun. 9, 2020

(54) LEVER-SWITCHING MULTIPLE FLUID-INPUT BEVERAGE DISPENSER

(71) Applicant: Automatic Bar Controls, Inc., Vacaville, CA (US)

(72) Inventor: Thomas R. Hecht

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 15/598,213

(22) Filed: May 17, 2017

(65) Prior Publication Data

US 2017/0334703 A1 Nov. 23, 2017

Related U.S. Application Data

(60) Provisional application No. 62/340,422, filed on May 23, 2016.

(51) Int. Cl.

| | |
|---|---|
| ***B67D 1/06*** | (2006.01) |
| ***B67D 1/04*** | (2006.01) |
| ***B67D 1/00*** | (2006.01) |
| ***B67D 1/14*** | (2006.01) |

(52) U.S. Cl.

CPC ..... *B67D 1/0082* (2013.01); *B67D 1/06* (2013.01); *B67D 1/1477* (2013.01); *B67D 1/0021* (2013.01); *B67D 1/0051* (2013.01); *B67D 1/04* (2013.01); *B67D 2001/0089* (2013.01); *B67D 2001/0094* (2013.01); *B67D 2210/00034* (2013.01)

(58) Field of Classification Search

CPC ..... B67D 1/008; B67D 1/0082; B67D 1/06; B67D 1/1477; B67D 1/0021; B67D 1/0051; B67D 1/04; B67D 2001/0089; B67D 2001/0094; B67D 2210/00034

USPC ..... 222/132, 129, 129.1–129.2, 134–137, 222/145.5–145.6

See application file for complete search history.

(56) References Cited

U.S. PATENT DOCUMENTS

| | | | | |
|---|---|---|---|---|
| 3,168,967 A * | 2/1965 | Giampa | B67D 1/0084 | 222/129.1 |
| 3,664,550 A * | 5/1972 | Carothers et al. | B67D 1/0083 | 222/129.2 |
| 3,735,898 A * | 5/1973 | Smith | B67D 1/06 | 222/129.4 |
| 4,497,421 A * | 2/1985 | Schilling | B67D 1/0084 | 137/607 |
| 4,741,355 A * | 5/1988 | Credle, Jr. | B67D 1/0044 | 137/269 |

(Continued)

*Primary Examiner* — Vishal Pancholi
*Assistant Examiner* — Andrew P Bainbridge
(74) *Attorney, Agent, or Firm* — Kilpatrick Townsend & Stockton LLP

(57) ABSTRACT

A beverage dispensing apparatus including at least one multiple lever-switching assembly where the lever assembly has a plurality of levers and valves configured to dispense fluids, flavorings, syrups, and optionally pressurized gas through one or more channels in each of the assemblies. The levers are part of a mechanical hydraulic system, that is not reliant on electrical connections to control or regulate the dispensing of fluids. Each set of levers can operate independently or in combination with other levers on the assembly, and can further actuate individual valves or more than one valve within the body of each assembly.

15 Claims, 5 Drawing Sheets

(56) References Cited

U.S. PATENT DOCUMENTS

| | | | | | |
|---|---|---|---|---|---|
| 4,993,604 | A * | 2/1991 | Gaunt | B67D 1/0079 | 222/129.1 |
| 5,033,648 | A * | 7/1991 | Nakayama | B67D 1/0044 | 222/129.1 |
| 5,042,692 | A * | 8/1991 | Valiyee | B67D 1/0084 | 222/144.5 |
| 5,105,982 | A * | 4/1992 | Takahashi | B67D 1/0079 | 222/129.1 |
| 6,761,036 | B2 * | 7/2004 | Teague | A23G 9/28 | 62/70 |
| 7,658,006 | B2 * | 2/2010 | Schroeder | B67D 1/0084 | 222/129.1 |
| 8,272,536 | B2 * | 9/2012 | Valiyee | B67D 1/0084 | 137/606 |
| 2010/0187258 | A1 * | 7/2010 | Santy | B67D 1/0044 | 222/129.1 |
| 2010/0264160 | A1 * | 10/2010 | Simmonds | B67D 1/1405 | 222/1 |
| 2010/0303971 | A1 * | 12/2010 | Melms, Jr. | A23C 9/1524 | 426/116 |
| 2011/0315711 | A1 | 12/2011 | Hecht et al. | | |

* cited by examiner

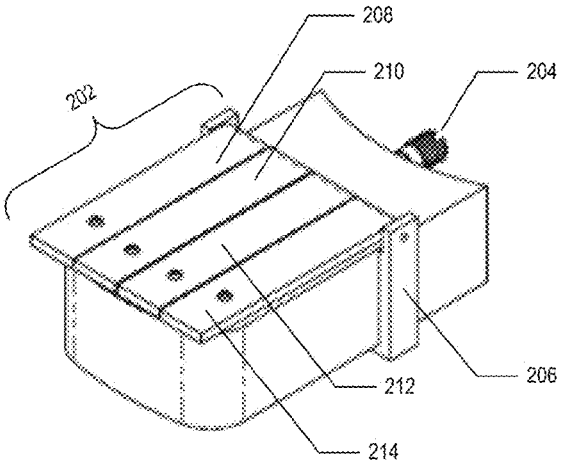
200 FIG. 9A
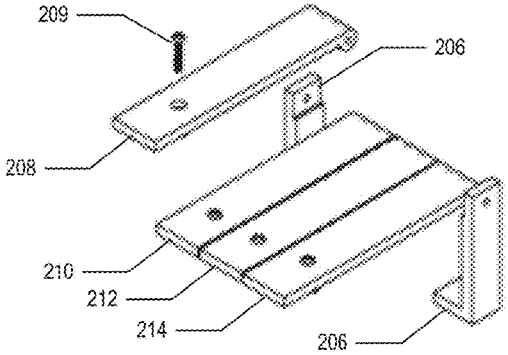
FIG. 9B
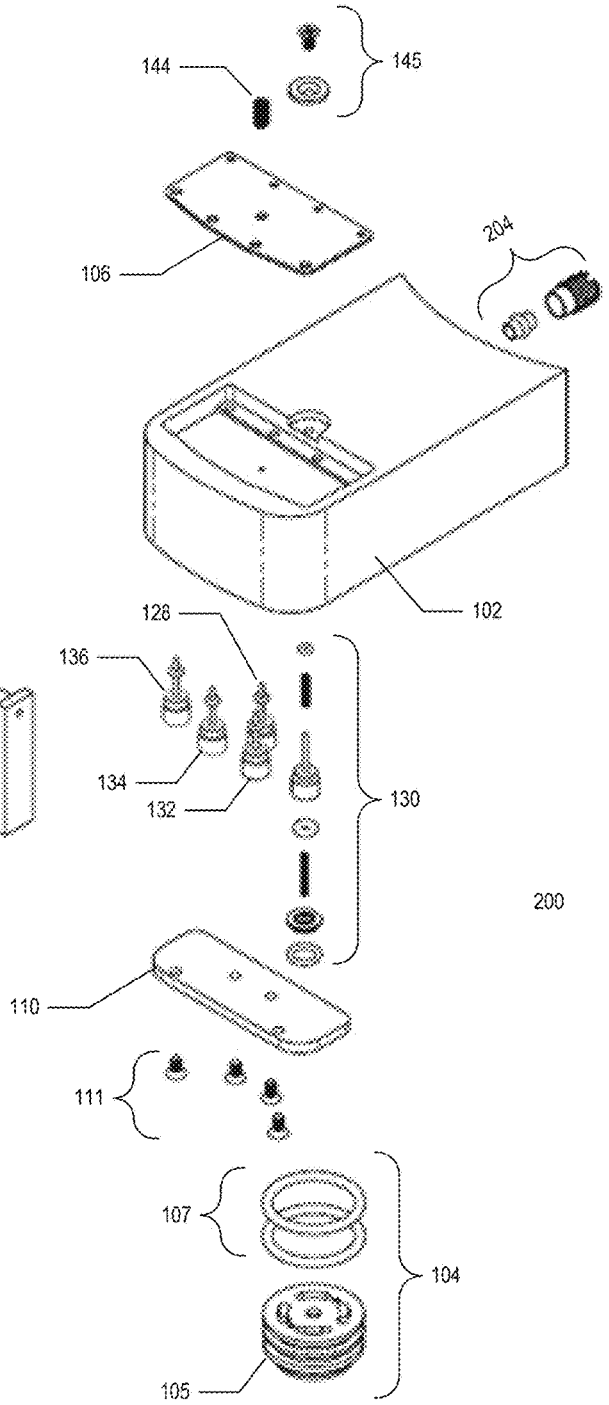

LEVER-SWITCHING MULTIPLE FLUID-INPUT BEVERAGE DISPENSER

CROSS-REFERENCES TO RELATED APPLICATIONS

This application claims priority to U.S. Provisional Application Ser. No. 62/340,422, filed May 23, 2016, entitled "Lever-Switching Multiple Fluid-Input Beverage Dispenser," the disclosure of which is hereby incorporated by reference in its entirety.

BACKGROUND OF THE INVENTION

The invention relates to a lever assembly for a beverage dispensing system.

Particularly, the invention relates to a lever assembly that can be installed on a tower beverage dispensing system, alternatively referred to as a "tea urn", a "kiosk", or a "fluid dispenser", to provide greater control and leverage in operating valves utilized by the beverage dispensing system for controlling the dispensing of a beverage.

Beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. These devices dispense the variety of beverages either by dispensing a single component beverage or by utilizing a dispensing array, also referred to as a diffuser, through which a single beverage may pass or a base beverage and a beverage additive, flow to a dispense point that facilitates discharge of beverages or beverage additives. The beverage components are then dispensed through a dispensing nozzle into a beverage container.

Some beverage dispensing systems are in the form of a beverage tower where the tower system can have a single nozzle or multiple nozzles for dispensing a beverage. When a single nozzle tower is used, it can be configured to dispense a variety of different beverages using valves in connection with a manifold and system of fluid lines connected to beverage sources allowing for distributing a mixed or single component beverage through a nozzle. Buttons can be used to activate the valves to control the flow of the beverage from the system. (The same concept is used with handheld bar guns except that the buttons and valves are located in the bar gun itself rather than in the beverage tower dispenser.) The beverage dispensers utilizing this concept have at least one button, and often numerous buttons, for controlling the dispensing of a single beverage component or a mixed beverage into a container.

Some operators perceive the buttons used on the described beverage dispensers to have some disadvantages because the buttons mechanically activate the valves of the beverage dispensing system. According to some operators, the buttons seem small and may fill with overspray from the beverage itself, causing them to get sticky and harder to depress with prolonged use. Some operators consider the buttons to lack any mechanical advantage because the force needed to open the valves is the same force required to operate the button. With prolonged use, some operators find operating the bar gun or tower assembly more difficult.

Accordingly, it is desirable to develop an assembly that can easily be installed on a tea urn or other such tower beverage dispensing device to make dispensing beverages easier.

BRIEF SUMMARY OF THE INVENTION

The present invention is related to beverage dispensing lever assemblies, and more specifically to beverage dispensing lever assemblies that are configured to be installed on a tea urn or tower beverage dispensing device, providing levers on the tea urn and/or beverage dispensing tower for activating valves for dispensing a beverage.

Embodiments of the present disclosure are generally directed to beverage dispenser lever assemblies, and more specifically to lever assemblies that engage valves within a tea urn and/or tower beverage dispensing device.

Further embodiments of the lever-switching beverage dispenser assembly in accordance with the present disclosure are configured so that the lever-switching beverage dispenser assembly can be installed as part of the original beverage dispensing tower or installed on a pre-existing tower beverage dispenser as a retrofit kit. In a circumstance such as upgrading with a retrofit kit, existing valve control structures, such as a button plate assembly, can be removed and can be replaced by the lever-switching beverage dispenser assembly using the existing screw positions of the tower beverage dispenser.

Some embodiments of the present disclosure implement a four-lever dispenser assembly, allowing for the distribution of fluid through four channels within a beverage dispenser valve unit. The four-level configuration can operate with each level operating independently as well as with any combination of the four levers operating concurrently, mixing fluid streams to be dispensed through the nozzle.

Further understanding of the nature and the advantages of the embodiments disclosed and suggested herein may be realized by reference to the remaining portions of the specification and the attached drawings.

BRIEF DESCRIPTION OF THE DRAWINGS

Illustrative aspects of the present disclosure are described in detail below with reference to the following drawing figures. It is intended that the embodiments, aspects and figures disclosed herein are to be considered illustrative rather than restrictive.

FIG. 9A is a perspective view of a lever-switching beverage dispenser assembly, having a beverage dispenser valve unit and four dispenser levers, according to aspects of the present disclosure.

FIG. 9B is an exploded view of the lever-switching beverage dispenser assembly as shown in FIG. 9A.

FIG. 10B is a perspective view of the tower beverage dispensing device as shown in

FIG. 10A.

11A.

Figure 11A:
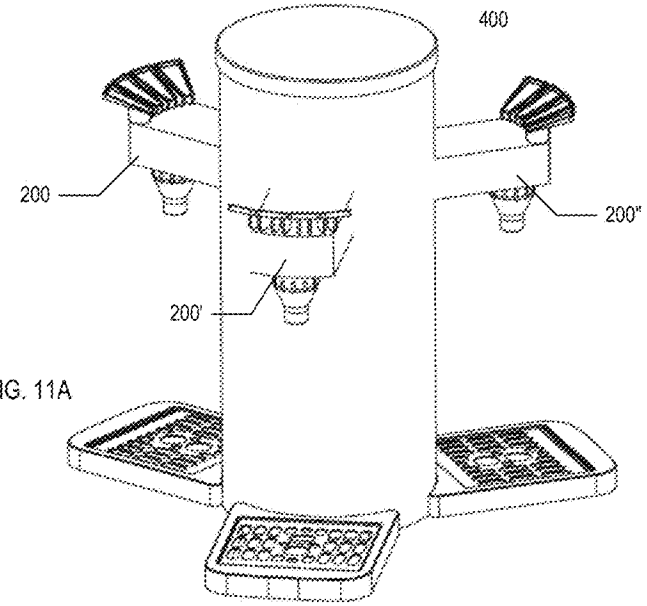
FIG. 11A is a perspective view of a tower beverage dispensing device having multiple lever-switching beverage dispenser assemblies, according to an embodiment of the present disclosure.
Figure 11D:
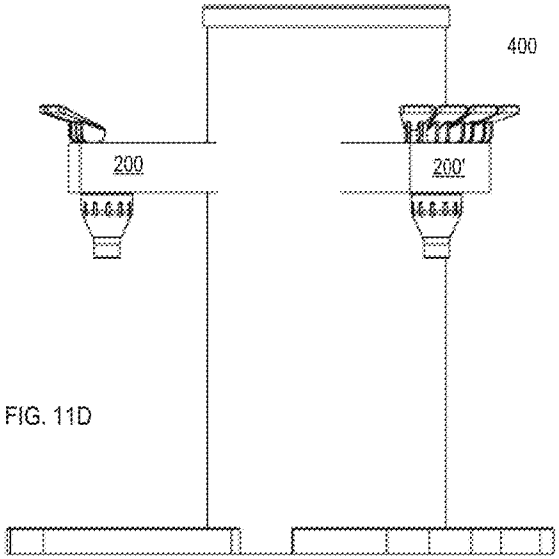
FIG. 11B is a top plan view of the tower beverage dispensing device as shown in FIG.
Figure 11B:
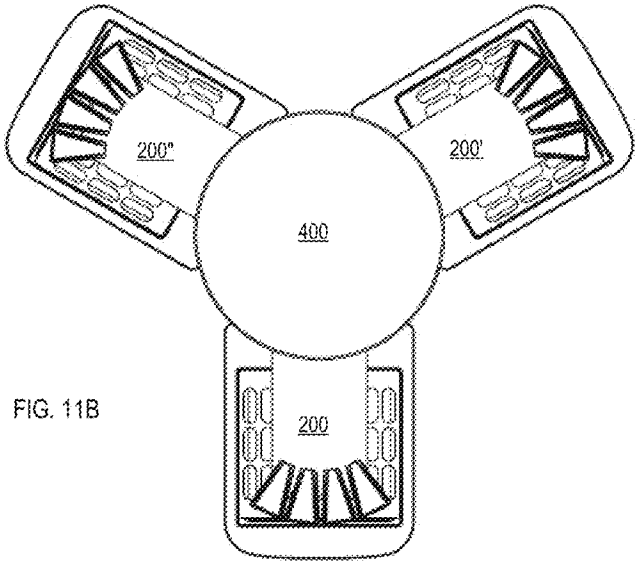
Figure 11C:
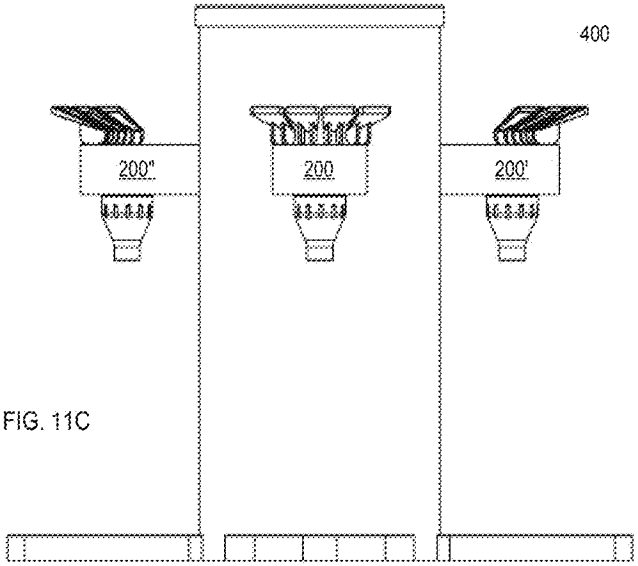

FIG. 11C is a front profile view of the tower beverage dispensing device as shown in FIG. 11A.

FIG. 11D is a side profile view of the tower beverage dispensing device as shown in FIG. 11A.

DETAILED DESCRIPTION OF THE INVENTION

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

Beverage dispensing towers can be configured with a nozzle, a tower, dispensing and flow control valves, and buttons for dispensing the beverage, where the buttons are installed on a fixed portion of the tower assembly. In some embodiments, dispensing and flow control valves can include a brixing device that contains shut off and flow valves for controlling the flow of beverage components from a beverage source to the nozzle of the dispensing tower. An exemplary tower beverage dispenser is described in Assignees' patent application, U.S. Patent Application Publication No. US 2011/0315711A1 to Hecht, which is incorporated by reference herein. Other similar tower beverage dispensers are commercially available from Automatic Bar Controls at www.wunderbar.com.

Generally, the buttons on a tower beverage dispenser allow an operator to select particular beverage components and/or dispense the beverage components in predetermined or customizable flow rates and volumes. These buttons can be numerous, or merely be a single button, depending on the intended use of the operator or establishment utilizing the tower. Operation of the tower beverage dispenser can include activating valves for dispensing a single beverage component or a mixed beverage solution, depending on the button pushed by the operator and the configuration of the valves. In use, the lever assembly according the present disclosure can be installed on a tower beverage dispensing device, connected to a beverage dispensing system, such as the one described above, to achieve some or all of the functionality of button controlled beverage dispensing systems.

Mechanical hydraulic lever systems as disclosed herein retain advantages over electromechanical systems that are seeing increased use and penetration in the industry. In many respects, a mechanical hydraulic system of control provides for a desired functionality, while having a lower cost as compared to electromechanical or digitally controlled systems. Indeed, the maintenance of a mechanical hydraulic system can be more straightforward than electromechanical or digitally controlled systems, where the relatively less complex mechanical system is relatively easier to assemble, disassemble and repair, and is inherently less prone to failure (i.e. more reliable) exactly because of the relatively less complex, yet still innovative, construction and design of the system. Further, a mechanical hydraulic system as disclosed herein is not dependent on building or grid electricity to function. Such a non-electrical implementation can be applicable to a wide variety of fluid dispensers, tea urn, kiosks, beverage towers, and the like.

The aspects of the disclosure herein can be further understood with reference to the exemplary devices shown in the Figures, although the invention is not limited to the depicted embodiments and may include many variations in accordance with the principles and aspects described herein.

Figure 1:
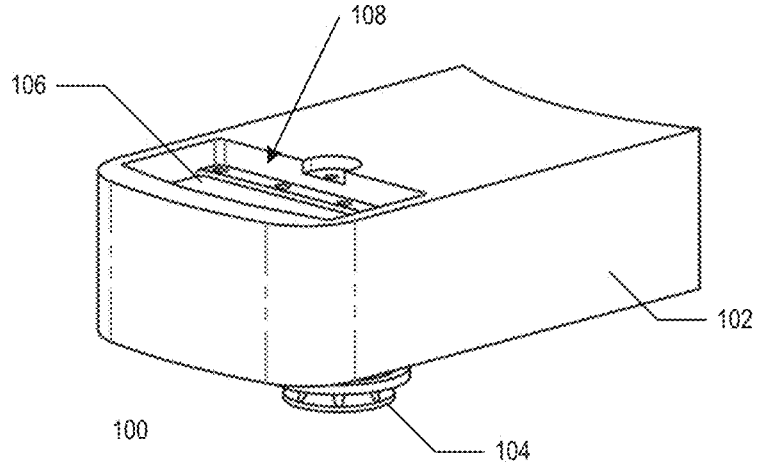
FIG. 1 is a front perspective view of a beverage dispenser valve unit, according to aspects of the present disclosure.

FIG. 1 is a front perspective view of a beverage dispenser valve unit 100. The beverage dispenser valve unit 100 includes a dispenser body 102 and a nozzle 104. The top side of the beverage dispenser valve unit 100 is configured to connect with levers for operating a beverage dispenser device, where the top side of the beverage dispenser valve unit 100 has an upper plate 106 (alternatively referred to as an actuating plate) set within an upper recess 108 of the dispenser body 102. In various aspects, dispenser body 102 can be formed of plastics, metals, alloys, or combinations thereof.

Figure 2:
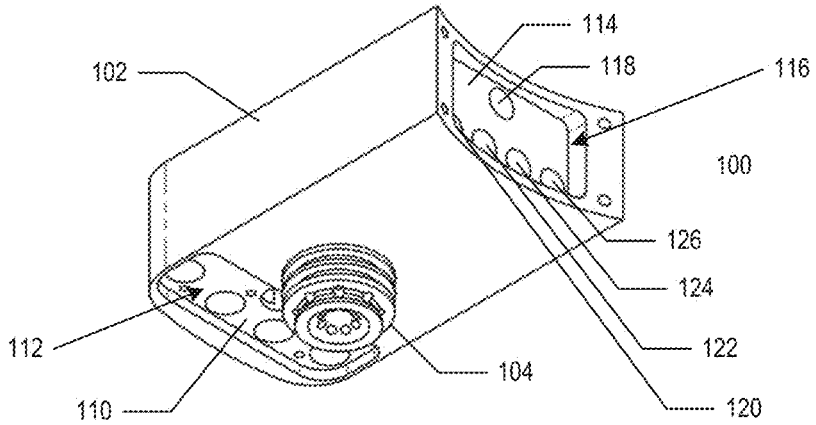
FIG. 2 is a back-bottom perspective view of the beverage dispenser valve unit as shown in FIG. 1.

FIG. 2 is a back-bottom perspective view of the beverage dispenser valve unit 100. The lower side of the dispenser body 102 can be generally, or in-part, symmetrical with the upper side of dispenser body 102. The lower side of the dispenser body 102 can have a lower plate 110 set within a lower recess 112, located opposite of the upper plate 106 and upper recess 108 through the thickness of the dispenser body 102. Further shown is a rear plate 114 set within a rear recess 116 of the dispenser body 102. Rear plate 114 can be configured to have holes or apertures cut into rear plate 114 that allowing for passage into dispenser body 102, providing for fluid flow paths (alternatively referred to as channels or passageways). As shown, rear plate 114 has five holes providing access to channels for fluid and/or gas flow, first channel 118, second channel 120, third channel 122, fourth channel 124, and fifth channel 126. Each and all of these channels can direct fluid and/or gas through dispenser body 102 toward nozzle 104, where nozzle 104 is an outlet for dispensing beverage.

Figure 3:
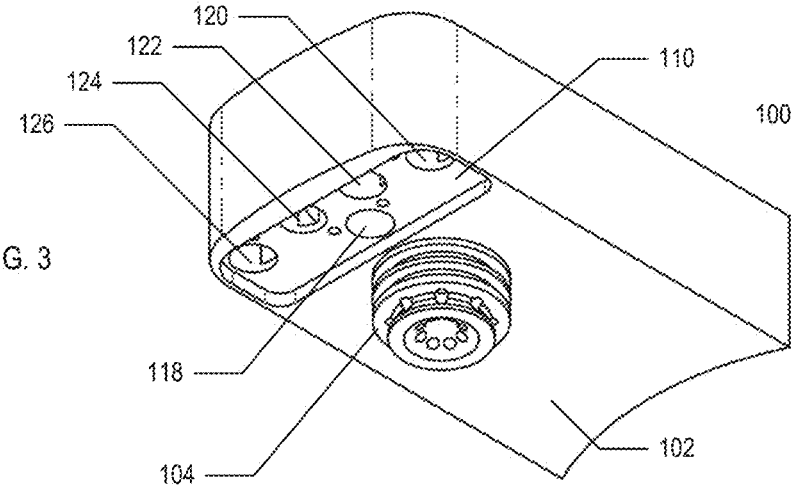
FIG. 3 is a front-bottom perspective view of the beverage dispenser valve unit as shown in FIG. 1.

FIG. 3 is a front-bottom perspective view of the beverage dispenser valve unit 100. Further shown in lower plate 110 are holes or apertures cut into lower plate 110, also forming each of first channel 118, second channel 120, third channel 122, fourth channel 124, and fifth channel 126 which pass through dispenser body 102. In other words, each of first channel 118, second channel 120, third channel 122, fourth channel 124, and fifth channel 126 pass through dispenser body 102 and connect the respective holes in rear plate 114 and lower plate 110. In FIG. 3, first channel 118, second channel 120, third channel 122, fourth channel 124, and fifth channel 126 are shown as open through lower plate 110. In use, valves described in further detail below can occupy the space within each of the first channel 118, the second channel 120, the third channel 122, the fourth channel 124, and the fifth channel 126 that is in the region of dispenser body 102 between upper plate 106 and lower plate 110. Opening and closing of such valves allows for control of fluid flow through each of the channels. Each of first channel 118, second channel 120, third channel 122, fourth channel 124, and fifth channel 126 can further be directed or route to nozzle 104 as an outlet.

Figure 4:
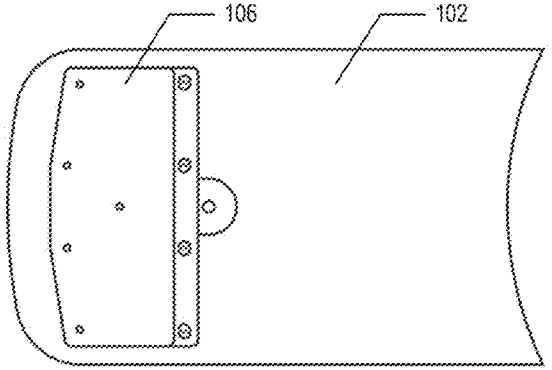
FIG. 4 is a top plan view of the beverage dispenser valve unit as shown in FIG. 1.
Figure 6:
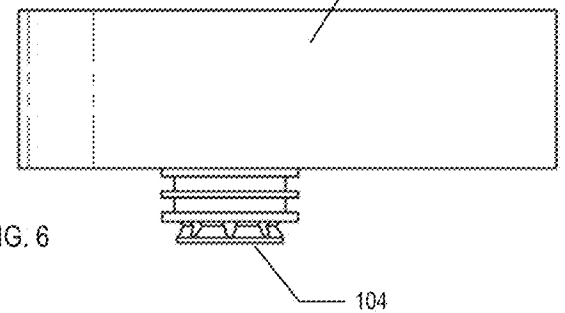
FIG. 6 is a side profile view of the beverage dispenser valve unit as shown in FIG. 1.
Figure 5:
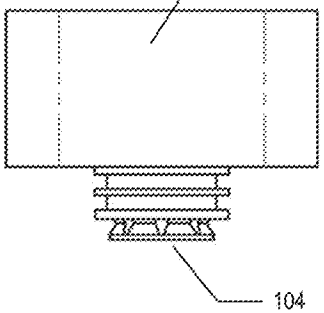
FIG. 5 is a front profile view of the beverage dispenser valve unit as shown in FIG. 1.

FIG. 4 is a top plan view of the beverage dispenser valve unit 100 and actuating upper plate 106, FIG. 5 is a front profile view of the beverage dispenser valve unit 100, and FIG. 6 is a side profile view of the beverage dispenser valve unit 100. As shown, dispenser body 102 can have a shape generally configured to have rounded edges toward the front of the dispenser body 102, and a parabolic or concave profile toward the back of the dispenser body 102. The rounded edges toward the front of dispenser body 102 allow for operation of the beverage dispenser valve unit 100 that can reduce potential injury or interference with levers due to the lack of sharp corners. The concave back end of the dispenser body 102 can be shaped to couple with a beverage tower such that the connection between the dispenser body 102 and beverage tower is flush and generally without any gaps between the two structures. In other embodiments, the shape of dispenser body 102 can be formed to have a back end that couples with a beverage tower having a flat, patterned, or otherwise curved shape.

Figure 7:
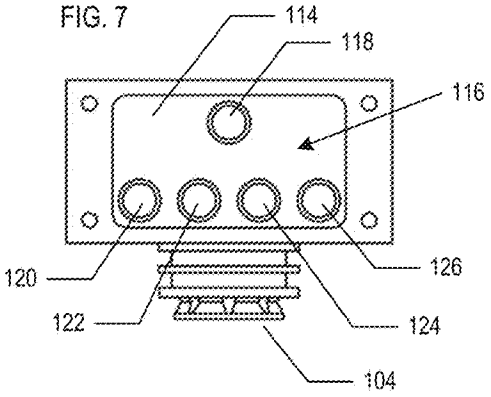
FIG. 7 is a back profile view of the beverage dispenser valve unit as shown in FIG. 1.

FIG. 7 is a back profile view of the beverage dispenser valve unit 100. FIG. 7 provides for a further illustration of apertures in rear plate 114 for first channel 118, second channel 120, third channel 122, fourth channel 124, and fifth channel 126 configured such that the aperture for first channel 118 is positioned above the apertures for second channel 120, third channel 122, fourth channel 124, and fifth channel 126. In such a configuration, one or the channels, for example first channel 118, can be used to connect to a gas source, such as a pressurized or carbonated gas source. The remaining channels can be used to connect to one or more fluid beverages sources. Other configurations of channels passing through rear plate 114 can have two or more channels used to convey gas. Yet further configurations can have one channel connected to a fluid source that includes a pressurized gas (e.g. a soda water stream) while the other channels can fluidly connect to a flavoring or syrup source, such that actuation of any one lever will allow for the mixing of the pressurized fluid source and the flavoring in order to dispense a beverage.

In some assemblies, not all of the channels will be connected to a gas or fluid source, since not every beverage tower will necessarily have a number of beverage source supplies to match the number of channels within the beverage dispenser valve unit 100. In some aspects, the fluid sources connected to one or more of the channels can hold the same beverage, different beverages, or combinations of beverages from one or more fluid sources. Nozzle 104 can be configured to receive fluid and/or gas through any or all of first channel 118, second channel 120, third channel 122, fourth channel 124, and fifth channel 126.

Figure 8:
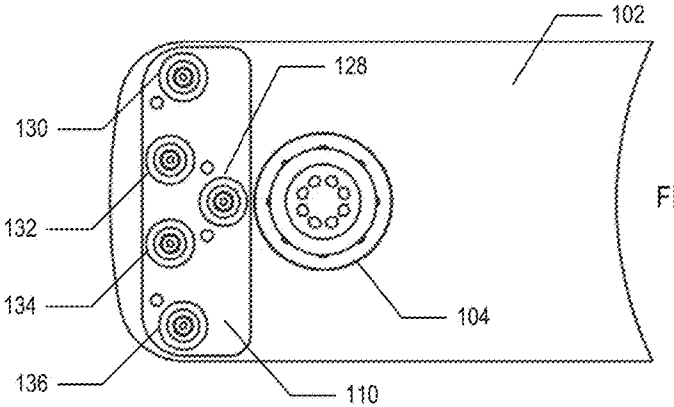
FIG. 8 is a bottom plan view of the beverage dispenser valve unit as shown in FIG. 1.

FIG. 8 is a bottom plan view of the beverage dispenser valve unit 100. As shown, through the lower plate 110, valves occupy the sections of the channels passing through the dispenser body 102 as the channels lead to the nozzle 104. In particular, FIG. 8 shows each of the first dispenser valve 128, second dispenser valve 130, third dispenser valve 132, fourth dispenser valve 134, and fifth dispenser valve 136 positioned in the path of first channel 118, second channel 120, third channel 122, fourth channel 124, and fifth channel 126, respectively. Each of the first dispenser valve 128, second dispenser valve 130, third dispenser valve 132, fourth dispenser valve 134, and fifth dispenser valve 136 can be individually actuated. In some aspects, any combination of the first dispenser valve 128, second dispenser valve 130, third dispenser valve 132, fourth dispenser valve 134, and fifth dispenser valve 136 can be actuated in combination with the other valves. In other aspects, a limited combination of the first dispenser valve 128, second dispenser valve 130, third dispenser valve 132, fourth dispenser valve 134, and fifth dispenser valve 136 can be actuated to be in an open position concurrently. For example, in some implementations, the first dispenser valve 128 can be in an open position simultaneously with any of the second dispenser valve 130, third dispenser valve 132, fourth dispenser valve 134, or fifth dispenser valve 136 in an open position, but only one of the second dispenser valve 130, third dispenser valve 132, fourth dispenser valve 134, or fifth dispenser valve 136 at any given time.

In various aspects, the valves used for any or all of the first dispenser valve 128, second dispenser valve 130, third dispenser valve 132, fourth dispenser valve 134, and fifth dispenser valve 136 can be gate valves, plunger valves, check valves, ball valves, other one-way valves, or the like.

FIG. 9A is a perspective view of a lever-switching beverage dispenser assembly 200, having a beverage dispenser valve unit 100 and four dispenser levers 202. An inlet 204 is shown connected to the rear of the dispenser body 102. The inlet 204 can be coupled to any one of the holes or apertures in rear place 110 so as to establish a gas or fluid communication path with any one of first channel 118, second channel 120, third channel 122, fourth channel 124, or fifth channel 126. Further, the dispenser levers 202 can be mechanically coupled to the dispenser body 102 by brackets 206, for example, where a pin anchored by brackets 206 passes through the dispenser levers 202, further providing for an axis of rotation around which the dispenser levers 202 can move. The four dispenser levers 202 shown can be further identified as a first lever 208, a second lever 210, a third lever 212, and a fourth lever 214. Each of the first lever 208, second lever 210, third lever 212, and fourth lever 214 can be mechanically connected to valves positioned within the gas and/or fluid channels within the dispenser body, such that actuating any one of the levers opens a respective valve (or valves) to allow a gas and/or fluid to pass through to the nozzle 104.

FIG. 9B is an exploded view of the lever-switching beverage dispenser 200 assembly as shown in FIG. 9A. Of the four dispenser levers 202, first lever 208 is shown separate from second lever 210, third lever 212, and fourth lever 214. Further shown is positioning pin 209, which in implementation is positioned to rest within a hole in first lever 208 toward the end of first lever 208 distal from the brackets 206 anchoring the dispenser levers 202 to the dispenser body 102. The positioning pin 209 can mechanically couple with a valve, for example, second dispenser valve 130 located beneath first valve 208, such that when first lever 208 is pressed down, the motion is translated through positioning pin 209 to move second dispenser valve 130 downward, thereby opening second dispenser valve 130 within second channel 120 to allow for gas and/or fluid to pass through that portion of second channel 120. Additionally or alternatively, positioning pin 209 situated within first lever 208 can be mechanically coupled to second dispenser valve 130 such that when first lever 208 is angled upward, motion is translated through positioning pin 209 to move second dispenser valve 130 upward, thereby opening second dispenser valve 130 within second channel 120 to allow for gas and/or fluid to pass through that portion of second channel 120. Each of second lever 210, third lever 212, and fourth lever 214 can also have positioning pins 209 located within a hole in each lever distal from brackets 206, and thus it can be understood that each of second lever 210, third lever 212, and fourth lever 214 can similarly be actuated to open respective valves within dispenser body 102. As shown, for example, each of second lever 210, third lever 212, and fourth lever 214 can be actuated to open third dispenser valve 132, fourth dispenser valve 134, and fifth dispenser valve 136, respectively.

In some implementations, any one or all of first lever 208, second lever 210, third lever 212, fourth lever 214, and/or the actuating plate 106 can be configured such that when actuated, first dispenser valve 128 is opened within first channel 118 concurrently with another dispenser valve to which the actuated lever is mechanically connected. Accordingly, in an exemplary embodiment, a system having a lever-switching beverage dispenser assembly 200 can be configured to have a gas route through first channel 118 and to have fluids route through second channel 120, third channel 122, fourth channel 124, and fifth channel 126. Operation of first lever 208 can open both first dispenser valve 128 and second dispenser valve 130, thereby channeling both gas and fluid through their respective passageways to nozzle 104. Each of second lever 210, third lever 212, and fourth lever 214 can be similarly operated. In other words, any one lever can be configured to be operable with and actuate the first dispenser valve 128 along with any one or combination of the second dispenser valve 130, the third dispenser valve 132, the fourth dispenser valve 134, and/or the fifth dispenser valve 136.

In alternative implementations, any one or more of first lever 208, second lever 210, third lever 212, fourth lever 214, and/or the actuating plate 106 can be configured such that when actuated, first dispenser valve 128 is not actuated, while the valves associated with the individual levers remain able to actuate. In other words, any one lever can be configured to not actuate the first dispenser valve 128, while still being operable to actuate any one or combination of the second dispenser valve 130, the third dispenser valve 132, the fourth dispenser valve 134, and/or the fifth dispenser valve 136. Such implementations can be applied, for example, for use or dispensing of a pre-mixed beverage or fluid.

Figure 10A:
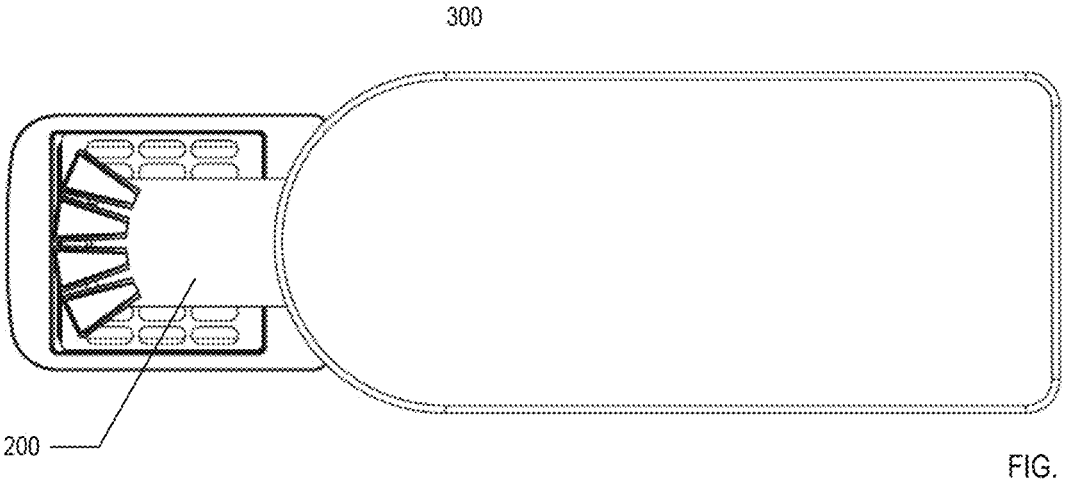
FIG. 10A is a top plan view of a tower beverage dispensing device with a lever-switching beverage dispenser assembly, according to an embodiment of the present disclosure.
Figure 10B:
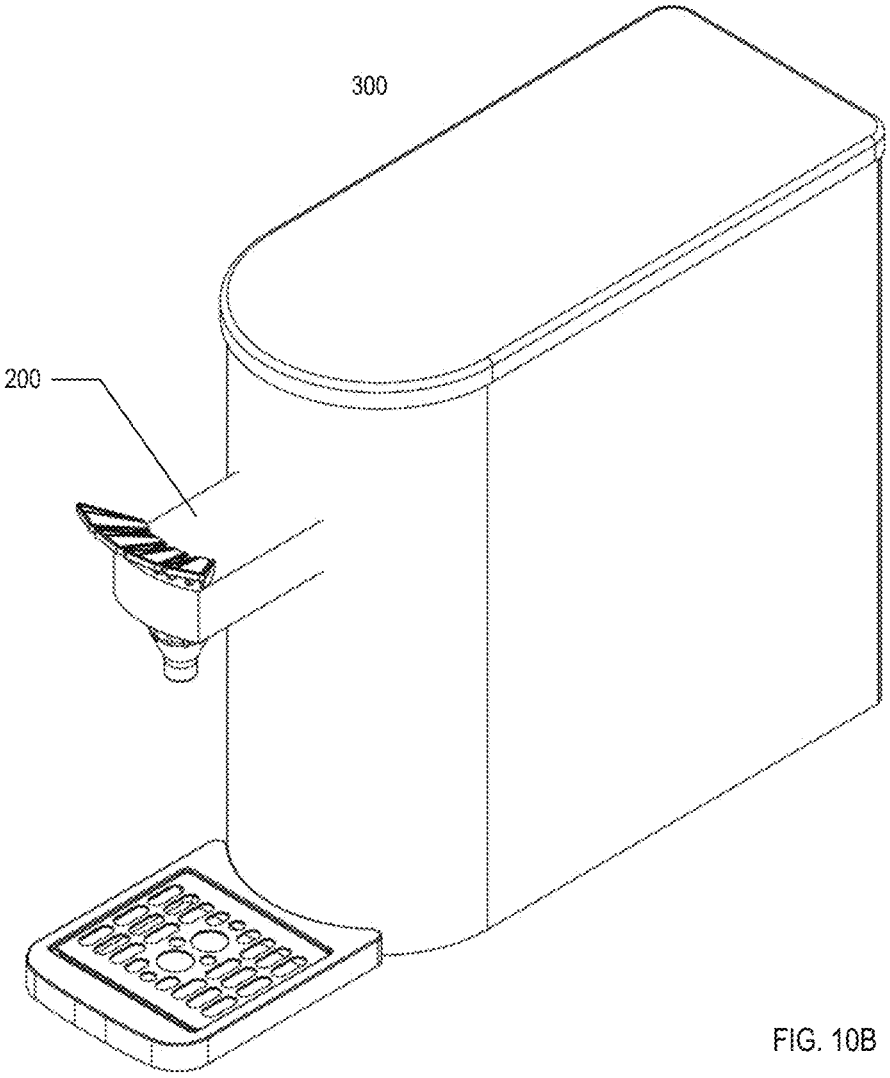

Further shown are set screw 144 along with washer and screw 145. Set screw 144 couples with actuating plate 106 and is positioned and configured to allow for adjusting the degree of actuation for first dispenser valve 128. Washer and screw 145 holds actuating upper plate 106 in position within the dispenser body 102 of the assembly. First dispenser valve 128, second dispenser valve 130, third dispenser valve 132, fourth dispenser valve 134, and fifth dispenser valve 136 are shown below dispenser body 102, removed from their respective channels, with second dispenser valve 130 shown as further exploded into constituent parts. Lower plate 110 is generally positioned under the dispenser valves when within the dispenser body 102, with valve setting pins 111 securing each of second dispenser valve 130, third dispenser valve 132, fourth dispenser valve 134, and fifth dispenser valve 136 within the dispenser body when assembled. Nozzle 104 is also further shown in detail, with O-rings 107 and aerator 105 forming nozzle 104, FIG. 10A is a top plan view of a tower beverage dispensing device 300 with a lever-switching beverage dispenser assembly 200. In some aspects, the tower beverage dispensing device 300 can hold both fluid reservoirs and gas sources, which can provide the fluid (i.e. beverage) and gas (e.g. pressurized carbon dioxide) to the lever-switching beverage dispenser assembly 200. In other aspects, the tower beverage dispensing device 300 can also include routing piping to conduct fluids and or gases to the lever-switching beverage dispenser assembly 200 from external sources. FIG. 10B is a perspective view of the tower beverage dispensing device as shown in FIG. 10A. As shown the four levers of the exemplary lever-switching beverage dispenser assembly 200 are configured to spread in a fan-like arrangement. In other embodiments, the levers of the lever-switching beverage dispenser assembly 200 can extend straight outward away from the main structure of the tower beverage dispensing device 300.

FIG. 11A is a perspective view of a tower beverage dispensing device 400 having multiple lever-switching beverage dispenser assemblies 200, 200', and 200". FIG. 11B is a top plan view of the tower beverage dispensing device 400 as shown in FIG. 11A, FIG. 11C is a front profile view of the tower beverage dispensing device 400 as shown in FIG. 11A, and FIG.

11D is a side profile view of the tower beverage dispensing device 400 as shown in FIG. 11A. As shown in FIG. 11A, an exemplary version of the beverage dispensing device 400 can include three multiple lever-switching beverage dispenser assemblies 200, 200', and 200". In some aspects, each individual multiple lever-switching beverage dispenser assembly can be substantially similar in construction, while in other aspects each individual multiple lever-switching beverage dispenser assembly can have variation (e.g. different numbers of levers, valves, channels, or the like). As in other embodiments, the tower beverage dispensing device 400 can hold both fluid reservoirs and gas sources, which can provide the fluid (i.e. beverage) and gas (e.g. pressurized carbon dioxide) to the lever-switching beverage dispenser assemblies 200, 200', and 200". In other aspects, multiple lever-switching beverage dispenser assemblies 200, 200', and 200" can have shared or separate connections to the same or different pressurized gas sources and/or flavoring or syrup sources. In other aspects, the tower beverage dispensing device 400 can also include routing piping to conduct fluids and or gases to the lever-switching beverage dispenser assemblies 200, 200', and 200" from external sources.

In further aspects of the tower beverage dispensing device 400 as shown in FIG. 11A, the three multiple lever-switching beverage dispenser assemblies 200, 200', and 200" can be positioned relatively equidistant away from each other as they extend outward from the main body of the tower beverage dispensing device 400, in this case, about 120 degrees away from each other around the circular body of the tower beverage dispensing device 400. It can be appreciated that further alternative embodiments of a tower beverage dispensing device can have two, three, four, five, or more than five multiple lever-switching beverage dispenser assemblies 200 extending outward from the main body of the tower beverage dispensing device, with those multiple lever-switching beverage dispenser assemblies optionally being positioned equidistantly or clustered relative to each other around the main body of the tower beverage dispensing device.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments and the disclosure generally, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lever-switching beverage dispenser assembly comprising:

a beverage dispenser valve unit, having a plurality of channels passing through the beverage dispenser valve unit, wherein each of the plurality of channels has one end directed toward a nozzle;

a plurality of valves, wherein at least one valve is positioned within each of the plurality of channels passing through the beverage dispenser valve unit; and a plurality of levers, each lever mechanically coupled to at least one of the plurality of valves and operable to open or close the at least one of the plurality of valves wherein a first lever of the plurality of levers is mechanically coupled to a first valve and a second valve of the plurality of valves so that a user directly pressing down on the first lever causes the first valve to dispense a first beverage component and causes the second valve to dispense a second beverage component in order for a first beverage comprising the first and second beverage components to be dispensed through the nozzle, and wherein a second lever of the plurality of levers is mechanically coupled to the first valve and a third valve of the plurality of valves so that the user directly pressing down on the second lever causes the first valve to dispense the first beverage component and causes the third valve to dispense a third beverage component in order for a second beverage comprising the first and third beverage components to be dispensed through the nozzle, wherein the plurality of levers comprise three or more levers each mechanically coupled with at least one positioning pin to at least one valve located within the beverage dispenser valve unit, and wherein any lever of the three or more levers is operable both independently and in combination with any other lever of the three or more levers.

2. The lever-switching beverage dispenser assembly of claim 1, wherein the plurality of channels passing through the beverage dispenser valve unit each have an open end of the channel in a rear face of the beverage dispenser valve unit.

3. The lever-switching beverage dispenser assembly of claim 1, comprising two or more channels passing through the beverage dispenser valve unit.

4. The lever-switching beverage dispenser assembly of claim 1, wherein the first lever is configured to not actuate the third valve.

5. The lever-switching beverage dispenser assembly of claim 1, wherein the first lever is mechanically coupled to the first valve and the second valve so that the user directly pulling up on the first lever causes the first valve to dispense the first beverage component and causes the second valve to dispense the second beverage component in order for the first beverage comprising the first and second beverage components to be dispensed through the nozzle, and wherein the second lever is mechanically coupled to the first valve and the third valve so that the user directly pulling up on the second lever causes the first valve to dispense the first beverage component and causes the third valve to dispense the third beverage component in order for the second beverage comprising the first and third beverage components to be dispensed through the nozzle.

6. A beverage dispensing system, comprising:

a beverage tower, comprising:

one or more fluid reservoirs; and a pressurized gas source;

at least one lever-switching beverage dispenser assembly, comprising:

a beverage dispenser valve unit comprising five channels passing therethrough toward a nozzle, wherein each of the five channels is in fluid communication with either any one of the fluid reservoirs or the pressurized gas source;

five valves, wherein one of the five valves is located within each of the five channels, wherein the five valves are located within respective channels between an actuating plate and a lower plate of the beverage dispenser valve unit; and a plurality of levers, each lever mechanically coupled to at least one of the five valves, wherein a first lever of the plurality of levers is mechanically coupled to a first valve and a second valve of the five valves so that a user directly pressing down on the first lever causes the first valve to dispense a first beverage component and causes the second valve to dispense a second beverage component in order for a first beverage comprising the first and second beverage components to be dispensed through the nozzle, and wherein a second lever of the plurality of levers is mechanically coupled to the first valve and a third valve of the five valves so that the user directly pressing down on the second lever causes the first valve to dispense the first beverage component and causes the_third valve to dispense a third beverage component in order for a second beverage comprising the first and third beverage components to be dispensed through the nozzle.

7. The beverage dispensing system of claim 6, wherein the five channels passing through the beverage dispenser valve unit each have an open end of the channel in a rear face of the beverage dispenser valve unit.

8. The beverage dispensing system of claim 6, wherein at least one of the plurality of channels is fluidly connected to a flavoring or syrup source.

9. The beverage dispensing system of claim 6, wherein at least one of the plurality of channels is fluidly connected to a pressurized fluid source.

10. The beverage dispensing system of claim 6, wherein the first lever is configured to not actuate the third valve.

11. The beverage dispensing system of claim 6, wherein the at least one lever-switching dispenser assembly comprises three lever-switching beverage dispenser assemblies positioned 120 degrees from each other around and extending from a circular body of the beverage tower.

12. The beverage dispensing system of claim 6, wherein the first lever is mechanically coupled to the first valve and the second valve so that the user directly pulling up on the first lever causes the first valve to dispense the first beverage component and causes the second valve to dispense the second beverage component in order for the first beverage comprising the first and second beverage components to be dispensed through the nozzle, and wherein the second lever is mechanically coupled to the first valve and the third valve so that the user directly pulling up on the second lever causes the first valve to dispense the first beverage component and causes the third valve to dispense the third beverage component in order for the second beverage comprising the first and third beverage components to be dispensed through the nozzle.

13. A beverage dispensing system, comprising:

a beverage tower, comprising:

one or more fluid reservoirs; and a pressurized gas source;

a lever-switching beverage dispenser assembly, comprising:

a beverage dispenser valve unit having a plurality of channels passing therethrough toward a nozzle, wherein each of the plurality of channels is in fluid communication with either any one of the fluid reservoirs or the pressurized gas source;

a plurality of valves, wherein one valves is located within each of the plurality of channels; and three or more levers each mechanically coupled with at least one positioning pin to at least one valve located within the beverage dispenser valve unit, wherein a first lever of the three or more levers is mechanically coupled to a first valve and a second valve of the plurality of valves so that a user directly pressing down on the first lever causes the first valve to dispense a first beverage component and causes the second valve to dispense a second beverage component in order for a first beverage comprising the first and second beverage components to be dispensed through the nozzle, wherein a second lever of the three or more levers is mechanically coupled to the first valve and a third valve of the plurality of valves so that the user directly pressing down on the second lever causes the first valve to dispense the first beverage component and causes the third valve to dispense a third beverage component in order for a second beverage comprising the first and third beverage components to be dispensed through the nozzle, and wherein each lever of the three or more levers is operable both independently and in combination with any other lever of the three or more levers.

14. A lever-switching beverage dispenser assembly, comprising:

a beverage dispenser valve unit, having a plurality of channels passing through the beverage dispenser valve unit, wherein each of the plurality of channels has one end directed toward a nozzle;

a plurality of valves, wherein at least one valve is positioned within each of the plurality of channels passing through the beverage dispenser valve unit; and three or more levers are mounted to the beverage dispenser valve unit in a spread fan-like arrangement, wherein each lever is mechanically coupled with at least one positioning pin to at least one valve located within the beverage dispenser valve unit and operable to open or close the at least one of the plurality of valves, wherein a first lever of the three or more levers is mechanically coupled to a first valve and a second valve of the plurality of valves so that a user directly pressing down on the first lever causes the first valve to dispense a first beverage component and causes the second valve to dispense a second beverage component in order for a first beverage comprising the first and second beverage components to be dispensed through the nozzle, and wherein a second lever of the three or more levers is mechanically coupled to the first valve and a third valve of the plurality of valves so that the user directly pressing down on the second lever causes the first valve to dispense the first beverage component and causes the third valve to dispense a third beverage component in order for a second beverage comprising the first and third beverage components to be dispensed through the nozzle.

15. A beverage dispensing system, comprising:

a beverage tower, comprising:

one or more fluid reservoirs; and a pressurized gas source;

a lever-switching beverage dispenser assembly, comprising:

a beverage dispenser valve unit having a plurality of channels passing therethrough toward a nozzle, wherein each of the plurality of channels is in fluid communication with either any one of the fluid reservoirs or the pressurized gas source;

a plurality of valves, wherein one valves is located within each of the plurality of channels; and three or more levers each mechanically coupled with at least one positioning pin to at least one valve located within the beverage dispenser valve unit, wherein a first lever of the three or more levers is mechanically coupled to a first valve and a second valve of the plurality of valves so that a user directly pressing down on the first lever causes the first valve to dispense a first beverage component and causes the second valve to dispense a second beverage component in order for a first beverage comprising the first and second beverage components to be dispensed through the nozzle, wherein a second lever of the three or more levers is mechanically coupled to the first valve and a third valve of the plurality of valves so that the user directly pressing down on the second lever causes the first valve to dispense the first beverage component and causes the third valve to dispense a third beverage component in order for a second beverage comprising the first and third beverage components to be dispensed through the nozzle, and wherein the three or more levers are mounted to the beverage dispenser valve unit in a spread fan-like arrangement.

* * * * *